United States Patent [19]

Gray

[11] Patent Number: 4,664,376

[45] Date of Patent: May 12, 1987

[54] LINE FAULT DETECTOR

[76] Inventor: George S. Gray, 191 North Parade, Mount Druitt, N.S. W., Australia, 2770

[21] Appl. No.: 519,772

[22] PCT Filed: Dec. 2, 1982

[86] PCT No.: PCT/AU82/00204

§ 371 Date: Jun. 30, 1983

§ 102(e) Date: Jun. 30, 1983

[87] PCT Pub. No.: WO83/01904

PCT Pub. Date: Jun. 9, 1983

[30] Foreign Application Priority Data

| | | | |
|---|---|---|---|
| Dec. 3, 1981 | [AU] | Australia | PF1819 |
| Dec. 7, 1981 | [AU] | Australia | PF1860 |
| Dec. 7, 1981 | [AU] | Australia | PF1861 |
| Aug. 10, 1982 | [AU] | Australia | PF5307 |

[51] Int. Cl.[4] ..... A63B 61/00; G08B 13/24

[52] U.S. Cl. ..... 273/29 R; 273/371; 273/61 R; 364/411; 340/323 R; 340/551

[58] Field of Search ..... 273/31, 374, 29 R, 50; 340/323 R, 551, 572; 434/339

[56] References Cited

U.S. PATENT DOCUMENTS

| | | | |
|---|---|---|---|
| 3,774,194 | 11/1973 | Jokay et al. . | |
| 3,812,484 | 5/1974 | Miller et al. | 340/551 |
| 3,854,719 | 12/1974 | Supran . | |
| 3,883,860 | 5/1975 | von Kohorn . | |
| 4,054,987 | 10/1977 | Forlenza | 273/29 R |
| 4,062,008 | 12/1977 | Carlsson et al. | 340/323 R |
| 4,071,242 | 1/1978 | Supran . | |
| 4,299,029 | 11/1981 | Van Auken . | |
| 4,299,384 | 11/1981 | Van Auken . | |
| 4,375,289 | 3/1983 | Schmall et al. | 340/323 R |
| 4,432,058 | 2/1984 | Supran | 340/323 R |

FOREIGN PATENT DOCUMENTS

| | | |
|---|---|---|
| 347326 | 1/1922 | Fed. Rep. of Germany . |
| 3001924 | 7/1981 | Fed. Rep. of Germany . |
| 1370331 | 10/1974 | United Kingdom . |
| 1370333 | 10/1974 | United Kingdom . |
| 1580360 | 12/1980 | United Kingdom . |

*Primary Examiner*—Richard C. Pinkham
*Assistant Examiner*—MaryAnn Stoll Lastova
*Attorney, Agent, or Firm*—Pennie & Edmonds

[57] ABSTRACT

A plurality of coils (2) are situated beneath a playing surface (4), for example of a tennis court, and extending end to end adjacent a boundary line (5). An oscillator circuit (FIG. 2) associated with each coil produces an electromagnetic field 9 in the coil vicinity. A detector circuit associated with each oscillator issues a detection signal when the field is disturbed by a ball comprising a metal or ferromagnetic material. A processor interrogates the detectors to determine which, if any, have issued a detection signal. Desirably, the ball has a metal or ferromagnetic material internally thereof. More preferably the metal is a foil urged against an interior wall of the ball by a resilient mass or bladder.

10 Claims, 6 Drawing Figures

LINE FAULT DETECTOR

TECHNICAL FIELD OF THE INVENTION

This invention relates to a sports ball for use with electronic ball detection systems and to a ball detection method and apparatus.

The invention will herein be described with particular reference to a tennis ball and a tennis ball detection system, but it will be understood that the invention is applicable to other ball games and is not limited to use for tennis.

BACKGROUND ART

As is well known, tennis is played on a court marked with lines. When a ball bounces on or close to certain of the lines an umpire must rule on whether the ball is within a designated area bounded by the lines, and hence in-play ("in") or is out-of-play ("out"). Because the tennis ball may be travelling at high speed, it is often difficult to judge by eye whether the ball is "in" or "out". When tennis is being played professionally the umpire's rulings may have considerable importance for players and/or sponsors.

A number of systems have been proposed for automatically detecting whether a tennis ball is "in" or "out". Most such systems utilize a tennis ball which is provided with a conductive outer surface. A plurality of closely spaced parallel exposed electrical conductors extend on and/or adjacent the lines and along the full length thereof. Contact of the conductive outer surface of the ball with adjacent conductors completes an electrical circuit. If the conductors of the circuit completed by the ball are within an "in" area of the court the apparatus signals the ball is "in". Such systems are exemplified in U.S. Pat. No. 3,883,860.

Tennis balls having an electrical conductive exterior for use in those systems are described in U.S. Pat. Nos. 4,299,384, 4,299,029, 4,071,242, and 3,854,719.

Systems dependent on conductive connection between exposed conductors on the court surface are susceptible to failure as a result of resistive corrosion either of the conductors of the court or of the ball, or covering of the conductors by insulators such as dirt, and to failure as a result of short circuits for example by moisture. Moreover the balls do not behave as do normal tennis balls or cause undue wear of racquets or the conductive surface of the ball fails as a result of wear prematurely in the ball life.

In U.S. Pat. No. 3,774,194 there is described a system which does not require exposed conductors. Instead a receiving antenna wire extends longitudinally of a court line and is buried beneath the line. There is provided a radio transmitter and a ball containing three coils at right angles acting as a resonant circuit tuned to the radiofrequency of the transmitter. The ball when in the vicinity of the court antenna acts as a coupler causing vertically polarised radiowaves from the transmitter to be sensed in the horizontal court antennae. In another embodiment a ball having a ferromagnetic metal or metal oxide included in the rubber composition thereof or having a thin layer of metal deposited on the outer surface of the rubber ball beneath a felt is used to unbalance a balanced bridge circuit.

That system is subject to interference by external signals and the balls required for use in the system do not have the properties of normal tennis balls and are expensive to manufacture.

None of the systems so far proposed has won wide acceptance and there is a continuing need for a satisfactory system of ball detection.

An object of the present invention is to provide a system which avoids at least some of the previously discussed disadvantages.

SUMMARY OF THE INVENTION

According to one aspect the invention consists in detection apparatus for sensing the proximity of a ball to a boundary when the ball comprises a metallic or ferromagnetic substance, said apparatus comprising:

a plurality of coils disposed each adjacent another along the boundary, an oscillator associated with each coil for generating an oscillating field in the coil vicinity, and a detector associated with each oscillator and responsive to a disturbance, if any, of the oscillating field by the metallic or ferromagnetic material of the ball to issue a detection signal whereby the proximity of the ball to the boundary may be detected.

According to another aspect the invention consists in a game ball for use with an electronic detector apparatus said ball comprising, a hollow resilient case, and a metal or metallic or magnetic composition interior of the case.

By way of example only an embodiment of the invention will now be described with reference to the accompanying drawings wherein:

PREFERRED EMBODIMENT OF THE INVENTION

In the present example the electronic system is required to detect when a tennis ball falls near a service line or tennis court boundary. The term boundary is herein used in a general sense to indicate the edge of an "in-play" area. Thus the boundary lines may differ during singles and doubles play and the center line may be a boundary line during service. Moreover the critical boundary of a centerline during service may alter depending on the direction of service.

Figure 3:
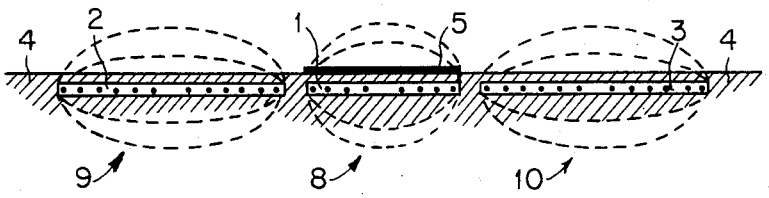
FIG. 3 shows a playing surface in cross-section with three detector coils in place.

With reference to FIG. 3, a plurality of coils 1, 2, 3 are disposed below the surface of the court 4 and adjacent the surface. The coils are elongate in the boundary direction and extend for example 30 cm longitudinally of the boundary. A plurality of coils 1 extend beneath the line 5 and are disposed each adjacent another in end-to-end relationship along the boundary.

Coils 2 are disposed each adjacent another in end-to-end relationship and are adjacent the boundary underlying an area extending to about 20 cm from the boundary.

Coils 3 are in a similar disposition to coils 2 but are on the opposite side of the boundary from coils 2 and also extend to about 20 cm from the boundary.

Figure 2:
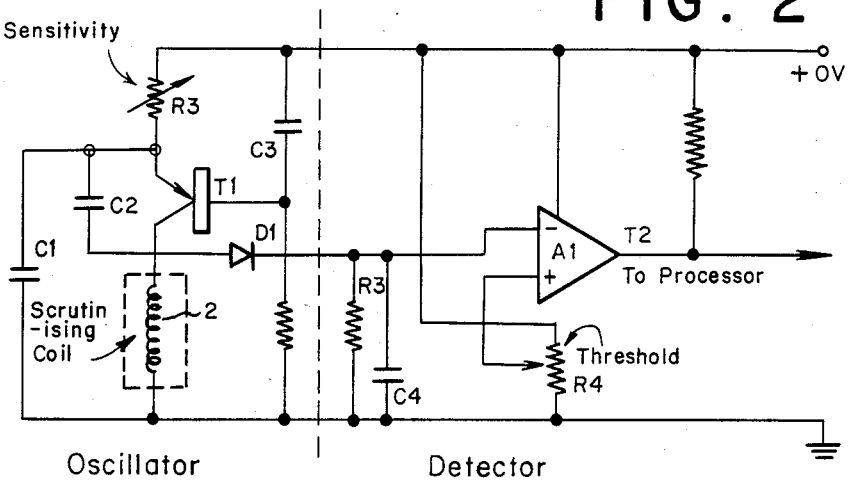
FIG. 2 shows schematically a circuit of a detector for use in the system of FIG. 1.

Each coil forms part of a detector circuit such as shown in FIG. 2. Each detector circuit comprises a coil which in the example illustrated is coil 2 and which together with capacitors C1, C2, C3, Transistor T1, diode D1, and resistor R1 and R2 forms an oscillator producing an oscillating electromagnetic field in coil 2. A similar circuit is associated with each of coils 1, each of coils 2 and each of coils 3 the respective oscillating fields being illustrated schematically in FIG. 3 at 8, 9 and 10. In practice that portion of each electromagnetic field which extends in the space immediately overlying the court surface should be relatively flat. The best field geometry may be determined by experiment utilizing various coil configurations or field shaping apparatus according to principles known in the art.

When a metallic or ferromagnetic material comes into proximity with the coils there is a reduction in the oscillation amplitude and provided the change is greater than a predetermined level set by threshold resistor R4, comparator A1 produces an output or detection signal at terminal T2.

Figure 1:
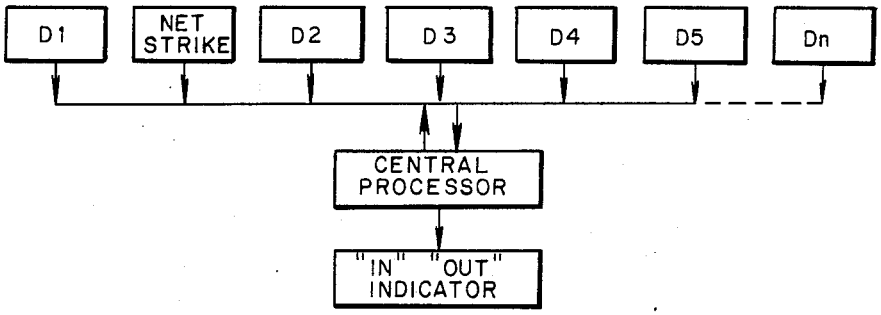
FIG. 1 shows a block diagram of a detector system according to the invention.

Output T2 may be used to set a latch for example a flip flop shown schematically in FIG. 1.

With reference to FIG. 1 a central processor 20 initially sends a "reset" signal to all detector latches and then interrogates each detector and latch combination (D1, D2 . . . Dn) in sequence to ascertain whether the comparator of any of them has issued an output signal in the interval since the last reset. The interrogation typically occurs thousands of times a second and continues until a detection signal is identified.

Thus if a metallized tennis ball falls on a court area overlying for example a coil 3, the oscillating field 10 is disturbed and the detector circuit issues a detection signal which activates a latch associated with the detector. The central processor interrogates the detectors in sequence and can identify which detector Dn was activated and thus can sense whether the ball was "in" or "out" it being known on which side of a boundary the coil of activated detector Dn is situated. Moreover the microprocessor can differentiate between coils at different linear sections of the boundary line and thus identify the section near which the ball landed to an accuracy dependent on the coil length in the boundary direction.

The output 21 from the microprocessor can thus be used to display the landing position on a video or other monitor 22 or to give other visible or audible or synthetic speech indication of whether the ball was "in" or "out".

While the circuit of FIG. 2 is shown with variable resistors for sensitivity control and threshold setting it is undesirable to have controls which require manual adjustment. In a preferred embodiment each detector circuit is provided with drift compensation and/or the detector circuit is arranged so that a detection signal is not issued as a result of slowly changing or drift conditions but issues only as a result of a transient change such as caused by a ball impact in the coil area.

As will be apparent to those skilled in the electronics art the detectors can be combined with logic circuits able to distinguish triggering of one detector from simultaneous triggering of two adjacent detectors and able to discriminate between detection events of various durations.

It will be understood that it is not essential to use three coils laterally of a boundary.

For example, in some cases, coils may be disposed along one side of the boundary only, and used to detect that the ball was "in" or "out", it being then assumed that if the ball does not register as "in" it is "out" or vice versa. In another example two adjacent coils may be used.

It will also be understood that the edge of a detecting field may not coincide exactly with the outer extremity of a coil, and that some experiment may be needed to determine the optimum lateral location for each coil relative to a boundary.

The coils may be disposed in flexible strip like sections which may be fixed to the court or may be formed in tiles intended to be laid level with the playing surface, or may be buried or placed in the tunnels or conduits beneath the playing surface or may be formed in the backing of synthetic court surfaces. Desirably the coils are substantially flat and may be produced by a printed circuit technique, the oscillator and detector being formed as a microchip.

Tennis-net vibration sensors and means to reverse direction as between "in" and "out" zones or to deactivate certain sensors for instance at the service line during service may be included.

Known conductive tennis balls are suitable for use with the apparatus herein described and include those metal coated on the outside or needled or woven with metal fibres in the outer skin or including metal particles in the rubber composition thereof as in prior art.

However it has been found to be particularly advantageous to use a ball which has metal on the interior thereof since such balls behave aerodynamically and resiliently more like a normal tennis ball and have less damaging effects on rackets or court surfaces than do the prior art detectable balls.

According to the present invention a preferred tennis ball includes metallic wool such as steel wool in the interior thereof or has a metallic coating of the interior wall which may be a metal containing composition, a metal foil, a film or a metal fabric interior of the ball.

During manufacture of a tennis ball by one method two rubber hemisphere shells 52 are joined to make a rubber ball to which an outer cover or flock 53 is bonded.

Figure 5:
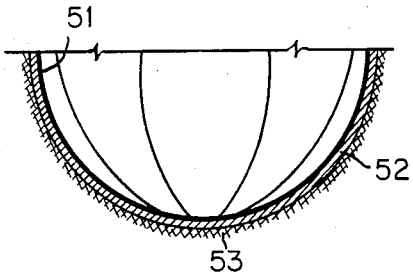
FIG. 5 is a schematic diagram of a half tennis ball in cross-section containing a metal foil lining according to the invention.

A highly preferred tennis ball for use in the invention (FIG. 5) includes a metal foil 51 pressed or bonded against the interior wall.

Figure 4:
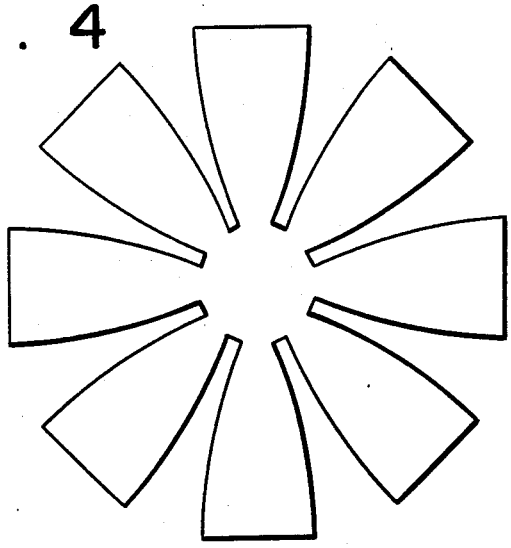
FIG. 4 is an aluminium foil shape prior to moulding into a hemispherical ball insert.

A shape such as shown in FIG. 4 may be stamped from aluminium foil and configured to form a substantially hemispherical shape which conforms to the interior spherical surface of the tennis ball. Each hemispherical rubber shell 52 is thus aluminium foil lined prior to forming two such halves into a rubber ball and applying outer cover 53.

Figure 6:
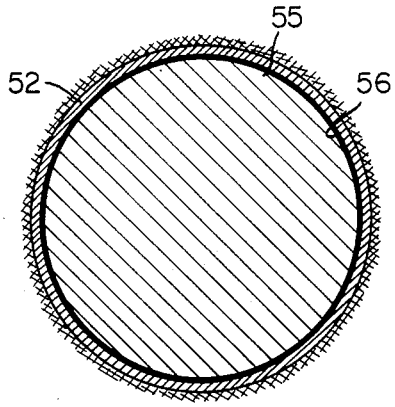
FIG. 6 is a schematic diagram of another tennis ball according to the invention.

Another preferred ball (FIG. 6) includes an interior resilient mass 55 or inflated bladder which presses a metallic or magnetic composition 56 or foil interposed between the outer case 52 and the resilient mass 55 or bladder. The interposed metal 56 may be in the form of a foil, a wool like "steelwool", or a mesh, or may be a powder or granules incorporated into for example, a rubber or plastics resilient composition.

If the resilient mass 55 is an inflated bladder, the bladder may be inflated prior to surrounding the bladder with the outer case halves and then fusing or welding the outer case halves together or otherwise moulding the outer case around the bladder and metal.

If preferred the bladder may contain a substance which evolves gas, for example upon being heated, and in that event the bladder may be enclosed in the outer case with the metallic component and subsequently caused to inflate and to press the metallic component against the outer case.

In another embodiment the resilient mass may consist of a plastics mass which contains a foaming or blowing agent and which is allowed to expand for example upon heating to form a resilient foam.

When aluminium foil is used as the metallic component in a tennis ball it has been found preferable to use a thin foil for example 1 to 20 microns, more preferably of from 5 to 9 microns in thickness. Foils having a thickness less than 20 microns are detectable while having sufficient flexibility and durability.

By virtue of the metal or metallic or magnetic composition held between the inner mass and outer case, the ball is detectable with metal detection apparatus. Since the metal is resiliently held against the outer wall the tennis ball is deformable as required for play and the metallic layer is otherwise substantially immobilized so as to avoid alteration to the characteristics of the ball during flight.

The detection system herein described has many advantages over prior art systems. It is capable of sensing a ball travelling at high speed and is relatively free from extraneous influence. The system is sensitive not only to proximity to a boundary but if desired may identify particular linear sections of the boundary distinguishing one part from another. The system permits balls to be used which perform more like normal balls than do prior art systems.

The system may be used in other games, for example in table tennis or playing-field ball games, and the balls of those games may be adapted in a manner similar to that described herein in relation to tennis balls.

The electronic circuits for use in the invention may be adapted in many ways to perform the function hereof and it will be understood that the invention is not limited to the specified examples described.

I claim:

1. Detection apparatus for sensing the proximity of a tennis-type ball to a tennis-type court boundary, the ball including a metallic or ferromagnetic substance, said apparatus comprising:

a plurality of first coils disposed each adjacent another longitudinally along and parallel to a single predetermined line of the boundary, a plurality of second coils disposed each adjacent another longitudinally along and parallel to the same single predetermined line of the boundary and substantially parallel to said first coils and spaced immediately laterally adjacent thereto by a distance no greater than about 20 cm., a plurality of oscillators, one associated with each coil for generating an associated oscillating field in the respective coil vicinity, a plurality of detectors, one associated with each oscillator and responsive to a disturbance, if any, of the associated oscillating field by the metallic or ferromagnetic material of the ball passing through said field to issue a detection signal, identifying means for issuing a signal identifying which one, if any, of said detectors has issued a detection signal, said identifying means including means for repeatedly separately scanning said detectors associated with said first and second plurality of coils in a sequence to issue a signal indicative of the location of any detector which has issued a detection signal, whereby the proximity of the ball to the boundary may be detected.

2. Apparatus according to claim 1 wherein the identification means includes a microprocessor.

3. Apparatus according to claim 1 wherein each coil is elongated and extends in the direction of a portion of said predetermined boundary line.

4. Apparatus according to claim 3 wherein the coil is buried adjacent the boundary.

5. Apparatus according to claim 3 wherein the coil is formed in a tile element forming a portion of the surface of a tennis court.

6. Apparatus according to claim 1 wherein the plurality of first and second coils include elongated coils disposed on opposite sides of the predetermined boundary line.

7. Detection apparatus for sensing the location of a tennis-type ball to individual lines of a tennis-type court boundary, the ball including a metallic or ferromagnetic substance, said apparatus comprising:

a plurality of at least ten coils disposed each adjacent another longitudinally along each of said individual lines of the boundary, a plurality of oscillators, one associated with each coil for generating an associated oscillating field in the repective coil vicinity, a plurality of detectors, one associated with each oscillator and responsive to a disturbance, if any, of the associated oscillating field by the metallic or ferromagnetic material of the ball passing through said field to issue a detection signal, identifying means for issuing a signal identifying which one, if any, of said detectors has issued a detection signal in response to disturbance of its associated oscillating field by the ball passing through said field, said identifying means including means for repeatedly scanning said detectors in a sequence along each of said individual lines to issue a signal indicative of the location of any detector which has issued a detection signal, whereby the location of the ball to the boundary may be detected as it passes through any one of said oscillating fields.

8. Detection apparatus for a tennis-type game for sensing the location of a tennis-type ball to individual lines of a tennis type court boundary, the ball having a metallic substance in the interior thereof constructed to substantially maintain the normal aerodynamic, resilience and deformability characteristics of the normal tennis-like ball, said apparatus comprising:

a plurality of at least ten coils disposed each adjacent another longitudinally along each of said individual lines of the boundary, a plurality of oscillators, one associated with each coil for generating an associated oscillating field in the respective coil vicinity, a plurality of detectors, one associated with each oscillator and responsive to a disturbance, if any, of the associated oscillating field by the metallic or ferromagnetic material of the ball passing through said field to issue a detection signal, identifying means for issuing a signal identifying which one, if any, of said detectors has issued a detection signal in response to disturbance of its associated oscillating field by the ball passing through said field, said identifying means including means for repeatedly scanning said detectors in a sequence along each of said individual lines to issue a signal indicative of the location of any detector which has issued a detection signal, said scanning being at a speed sufficient to repeat the scanning of any one detector within the time it takes said ball to disturb the oscillating field of the oscillator associated with said one detector by passing through said field during normal speeds associated with said tennis-type game, whereby the location of the ball to the boundary may be detected as it passes through any one of said oscillating fields.

9. Apparatus according to claim 8 wherein the coils each extend for about 30 cm along each of said individual lines of the boundary.

10. Detection apparatus for a tennis-type game for sensing the location of a tennis-type ball to a tennis-type court boundary, the ball having a metallic substance in the interior thereof constructed to substantially maintain the normal aerodynamic, resilience and deformability characteristics of the normal tennis-like ball, said apparatus comprising:

a plurality of coils disposed each adjacent another longitudinally along the boundary, including:

(a) a first plurality of coils disposed each adjacent another longitudinally along the boundary immediately adjacent one side thereof;

(b) a second plurality of coils disposed each adjacent another longitudinally along the boundary immediately adjacent the other side thereof; and (c) a third plurality of coils disposed adjacent another longitudinally along the boundary and immediately therebelow;

a plurality of oscillators, one associated with each coil for generating an associated oscillating field in the respective coil vicinity;

a plurality of detectors, one associated with each oscillator and responsive to a disturbance, if any, of the associated oscillating field by the metallic or ferromagnetic material of the ball passing through said field to issue a detection signal;

identifying means for issuing a signal identifying which one, if any of said detectors has issued a detection signal in response to disturbance of its associated oscillating field by the ball passing through said field, said identifying means including means for repeatedly scanning said detectors in a sequence to issue a signal indicative of the location of any detector which has issued a detection signal, said scanning being at a speed sufficient to repeat the scanning of any one detector within the time it takes said ball to disturb the oscillating field of the oscillator associated with said one detector by passing through said field during normal speeds associated with said tennis-type game;

whereby the location of the ball to the boundary may be detected as it passes through any one of said oscillating fields.

* * * * *